US009315011B2

(12) United States Patent
Kersten et al.

(10) Patent No.: US 9,315,011 B2
(45) Date of Patent: Apr. 19, 2016

(54) INTAGLIO PRINTING PRESS

(71) Applicant: KBA-NOTASYS SA, Lausanne (CH)

(72) Inventors: Thomas Kersten, Lausanne (CH); Johannes Georg Schaede, Würzburg (DE); Alain Würsch, La Tour-de-Peilz (CH); Volkmar Rolf Schwitzky, Würzburg (DE); Volker Scharkus, Würzburg (DE)

(73) Assignee: KBA-NotaSys SA, Lausanne (CH)

( * ) Notice: Subject to any disclaimer, the term of this patent is extended or adjusted under 35 U.S.C. 154(b) by 3 days.

(21) Appl. No.: 14/396,172

(22) PCT Filed: Apr. 24, 2013

(86) PCT No.: PCT/IB2013/053247
§ 371 (c)(1),
(2) Date: Oct. 22, 2014

(87) PCT Pub. No.: WO2013/160853
PCT Pub. Date: Oct. 31, 2013

(65) Prior Publication Data

US 2015/0135977 A1 May 21, 2015

(30) Foreign Application Priority Data

Apr. 24, 2012 (EP) ..... 12165388

(51) Int. Cl.
*B41F 9/08* (2006.01)
*B41F 9/06* (2006.01)
(Continued)

(52) U.S. Cl.
CPC . *B41F 9/061* (2013.01); *B41F 9/00* (2013.01); *B41F 9/01* (2013.01); *B41F 9/08* (2013.01);
(Continued)

(58) Field of Classification Search
CPC ..... B41F 9/08; B41F 9/10; B41F 9/06; B41F 3/38; B41F 13/004
See application file for complete search history.

(56) References Cited

U.S. PATENT DOCUMENTS 3,604,350 A * 9/1971 Rosenstadt ..... 101/181
4,409,896 A * 10/1983 Hamisch, Jr. ..... 101/367
(Continued)

FOREIGN PATENT DOCUMENTS

EP 0 653 302 5/1995
EP 0 984 201 3/2000
(Continued)

OTHER PUBLICATIONS

International Search Report for PCT/IB2013/053247, mailed Nov. 15, 2013, 5 pages.
(Continued)

*Primary Examiner* — David Banh
(74) *Attorney, Agent, or Firm* — Nixon & Vanderhye P.C.

(57) ABSTRACT

There is described an intaglio printing press (1; 1*) comprising a plate cylinder (8) carrying one or more intaglio printing plates, the plate cylinder (8) receiving ink from an inking system (9, 20, 23; 20*, 23*) having a plurality of chablon cylinders (23; 23*) transferring ink directly or indirectly onto the plate cylinder (8), the intaglio printing press (1; 1*) comprising an adjustment system acting on the chablon cylinders (23; 23*) in order to compensate elongation of the one or more intaglio printing plates. The adjustment system comprises, for each chablon cylinder (23; 23*), an adjustable drive unit, which adjustable drive unit (25) is interposed between the chablon cylinder (23; 23*) acting as a rotating output body of the adjustable drive unit (25) and a driving gear (100) acting as a rotating input body of the adjustable drive unit (25). The adjustable drive unit (25) is designed to allow selected adjustment of a rotational speed of the chablon cylinder (23; 23*) with respect to a rotational speed of the driving gear (100). In an adjusting state of the adjustable drive unit (25), driving into rotation of the chablon cylinder (23; 23*) is adjusted over each revolution of the chablon cylinder (23; 23*) by means of an adjustment motor (300) of the adjustable drive unit (25). In a non-adjusting state of the adjustable drive unit (25), the adjustment motor (300) is inoperative and driving into rotation of the chablon cylinder (23; 23*) is performed exclusively mechanically via the adjustable drive unit (25), the chablon cylinder (23; 23*) rotating at a same rotational speed as the driving gear (100).

17 Claims, 9 Drawing Sheets

(51) Int. Cl.

| | |
|---|---|
| ***B41F 13/00*** | (2006.01) |
| ***B41F 13/008*** | (2006.01) |
| ***B41F 9/00*** | (2006.01) |
| ***B41F 9/01*** | (2006.01) |
| ***B41F 9/10*** | (2006.01) |

(52) U.S. Cl.

CPC ..... *B41F 9/10* (2013.01); *B41F 13/0008* (2013.01); *B41F 13/008* (2013.01); *B41P 2213/208* (2013.01)

(56) References Cited

U.S. PATENT DOCUMENTS

| | | | | |
|---|---|---|---|---|
| 4,892,035 | A * | 1/1990 | Terzuolo | 101/148 |
| 4,953,461 | A * | 9/1990 | Gaffney et al. | 101/142 |
| 5,011,458 | A * | 4/1991 | Kumm | 474/49 |
| 5,765,482 | A * | 6/1998 | Wittkopf et al. | 101/228 |
| 5,950,502 | A | 9/1999 | Genovese | |
| 6,014,907 | A * | 1/2000 | Rilbe | 74/395 |
| 6,050,187 | A * | 4/2000 | Kuhn et al. | 101/155 |
| 6,111,261 | A | 8/2000 | Bolza-Schunemann et al. | |
| 6,176,482 | B1 | 1/2001 | Reinhard et al. | |
| 6,308,622 | B1 * | 10/2001 | Steffen et al. | 101/248 |
| 7,011,020 | B2 | 3/2006 | Dunninger et al. | |
| 7,806,051 | B2 | 10/2010 | Schaede | |
| 8,231,125 | B2 | 7/2012 | Hendle et al. | |
| 8,516,960 | B2 | 8/2013 | Bollettin et al. | |
| 2004/0237816 | A1 | 12/2004 | Dunninger et al. | |
| 2005/0016399 | A1 * | 1/2005 | Holm et al. | 101/352.06 |
| 2005/0039617 | A1 * | 2/2005 | Kusaka et al. | 101/216 |
| 2005/0127595 | A1 | 6/2005 | Hendle et al. | |
| 2006/0144265 | A1 | 7/2006 | Dunninger et al. | |
| 2006/0162591 | A1 | 7/2006 | Schaede | |
| 2009/0096156 | A1 | 4/2009 | Hendle et al. | |
| 2009/0183644 | A1 | 7/2009 | Bollettin et al. | |
| 2010/0147168 | A1 * | 6/2010 | Puschel et al. | 101/217 |
| 2012/0046142 | A1 * | 2/2012 | Miyawaki et al. | 475/331 |
| 2012/0312180 | A1 | 12/2012 | Scheade et al. | |
| 2012/0328179 | A1 | 12/2012 | Scheade et al. | |
| 2013/0112095 | A1 * | 5/2013 | Schaede et al. | 101/153 |
| 2013/0312625 | A1 * | 11/2013 | Kamoda | 101/153 |
| 2014/0218502 | A1 | 8/2014 | Schaede et al. | |

FOREIGN PATENT DOCUMENTS

| | | |
|---|---|---|
| EP | 1 717 025 | 11/2006 |
| EP | 2 338 682 | 6/2011 |
| WO | WO 97/36813 | 10/1997 |
| WO | WO 97/37329 | 10/1997 |
| WO | WO 03/047862 | 6/2003 |
| WO | WO 03/070465 | 8/2003 |
| WO | WO 2004/069538 | 1/2004 |
| WO | WO 2007/116353 | 10/2007 |
| WO | WO 2011/077350 | 6/2011 |
| WO | WO 2011/077351 | 6/2011 |
| WO | WO 2011077348 A1 * | 6/2011 |
| WO | WO 2011/161656 | 12/2011 |

OTHER PUBLICATIONS

Written Opinion for PCT/IB2013/053247, mailed Nov. 15, 2013, 6 pages.

* cited by examiner

INTAGLIO PRINTING PRESS

This application is the U.S. national phase of International Application No. PCT/IB2013/053247, filed 24 Apr. 2013, which designated the U.S. and claims priority to EP Application No. 12165388.5, filed 24 Apr. 2012, the entire contents of each of which are hereby incorporated by reference.

TECHNICAL FIELD

The present invention generally relates to an intaglio printing press of the type comprising a plate cylinder carrying one or more intaglio printing plates, the plate cylinder receiving ink from an inking system having a plurality of chablon cylinders transferring ink directly or indirectly onto the plate cylinder, the intaglio printing press comprising an adjustment system acting on the chablon cylinders in order to compensate elongation of the one or more intaglio printing plates.

BACKGROUND OF THE INVENTION

International Publication No. WO 2004/069538 A2 discloses the use of independent drives to allow for an adjustment of the inking length of individual chablon cylinders as transferred onto a plate cylinder of an intaglio printing press with a view to compensate for elongation of the intaglio printing plates carried by the plate cylinder.

A problem with the above solution resides in the fact that, in case of failure of an independent drive, the associated system and function become inoperative and cannot be exploited further unless the defective drive is replaced by a new drive, which process is typically time-consuming and involves substantial downtimes which negatively affect productivity.

An improved and more robust approach is therefore required.

SUMMARY OF THE INVENTION

A general aim of the invention is therefore to provide an intaglio printing press of the above-mentioned type comprising an adjustment system which is more robust than the solutions known in the art.

A further aim of the invention is to provide such a solution which is as compact as possible in order to facilitate the integration thereof in the intaglio printing press.

Yet another aim of the invention is to provide such a solution which can be efficiently used to adjust the inking length of individual chablon cylinders as transferred onto the plate cylinder of the intaglio printing press for the purpose of compensating elongation of the intaglio printing plates carried by the plate cylinder.

These aims are achieved thanks to the adjustable drive unit defined in the claims.

There is accordingly provided an intaglio printing press comprising a plate cylinder carrying one or more intaglio printing plates, the plate cylinder receiving ink from an inking system having a plurality of chablon cylinders transferring ink directly or indirectly onto the plate cylinder, the intaglio printing press comprising an adjustment system acting on the chablon cylinders in order to compensate elongation of the one or more intaglio printing plates, wherein the adjustment system comprises, for each chablon cylinder, an adjustable drive unit, which adjustable drive unit is interposed between the chablon cylinder acting as a rotating output body of the adjustable drive unit and a driving gear acting as a rotating input body of the adjustable drive unit. The adjustable drive unit is designed to allow selected adjustment of a rotational speed of the chablon cylinder with respect to a rotational speed of the driving gear. In an adjusting state of the adjustable drive unit, driving into rotation of the chablon cylinder is adjusted over each revolution of the chablon cylinder by means of an adjustment motor of the adjustable drive unit to change an inking length of the chablon cylinder as transferred onto the plate cylinder. In a non-adjusting state of the adjustable drive unit, the adjustment motor is inoperative and driving into rotation of the chablon cylinder is performed exclusively mechanically via the adjustable drive unit, the chablon cylinder rotating at a same rotational speed as the driving gear.

In accordance with the invention, it shall therefore be appreciated that the adjustment motor is only operative in the adjusting state of the adjustable drive unit, i.e. the adjustment motor is only used for the purpose of adjusting a rotational speed of the chablon cylinder with respect to the rotational speed of the driving gear. In the non-adjusting state, the adjustment motor is totally inoperative and the chablon cylinder is driven into rotation exclusively mechanically via the adjustable drive unit. In other words, any failure of the adjustment motor will not have any impact on the normal operation of the intaglio printing press. In addition, since the adjustment motor is only operative in the adjusting state of the adjustable drive unit, usage of the adjustment motor is reduced, leading to an extended usability.

In accordance with a preferred embodiment of the invention, the adjustable drive unit comprises an adjustable mechanical transmission unit having a drive input coupled to and rotating together with the driving gear, a drive output coupled to and rotating together with the chablon cylinder, and a control input coupled to and driven into rotation by the adjustment motor.

According to a preferred embodiment, the adjustable mechanical transmission unit is designed as a harmonic drive unit comprising first and second harmonic drives coupled to one another in a mirrored configuration. In this context, the first harmonic drive may in particular act as a reducer stage with a defined reduction factor and the second harmonic drive may act, in the non-adjusting state of the adjustable drive unit, as an overdrive stage with a defined overdrive factor that is the inverse of the defined reduction factor of the reducer stage. In this way, in the non-adjusting state of the adjustable drive unit, the overall reduction factor of the harmonic drive unit is 1:1, meaning that the chablon cylinder will rotate at the same rotational speed as the driving gear. In the adjusting state of the adjustable drive unit, the second harmonic drive may act as a differential stage having a differential output whose rotational speed is a differential function of a rotational speed at a differential input of the differential stage and a rotational speed at a differential control input of the differential stage.

In a particularly advantageous variant of the above embodiment, each one of the first and second harmonic drives comprises a wave generator, a flexspline, a circular spline, and a dynamic spline, the dynamic spline of the first harmonic drive being coupled to the driving gear to act as the drive input of the harmonic drive unit, while the wave generator of the first harmonic drive is fixed in rotation and the circular spline of the first harmonic drive is coupled to and rotates together with the circular spline of the second harmonic drive. In addition, the wave generator of the second harmonic drive is coupled to and driven into rotation by the adjustment motor to act as the control input of the harmonic drive unit, while the dynamic spline of the second harmonic drive is coupled to and rotates together with the rotating output body to act as the drive output of the harmonic drive unit.

Preferably, the intaglio printing press further comprises an output drive gear coupled to and rotating together with the chablon cylinder to drive an inking device inking the chablon cylinder.

Also claimed is an adjustment system designed to compensate elongation of one or more intaglio printing plates of the aforementioned intaglio printing press.

Further advantageous embodiments of the adjustable drive unit and of the printing press form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of the application to an intaglio printing press as used for the production of banknotes and like security documents.

Figure 1:
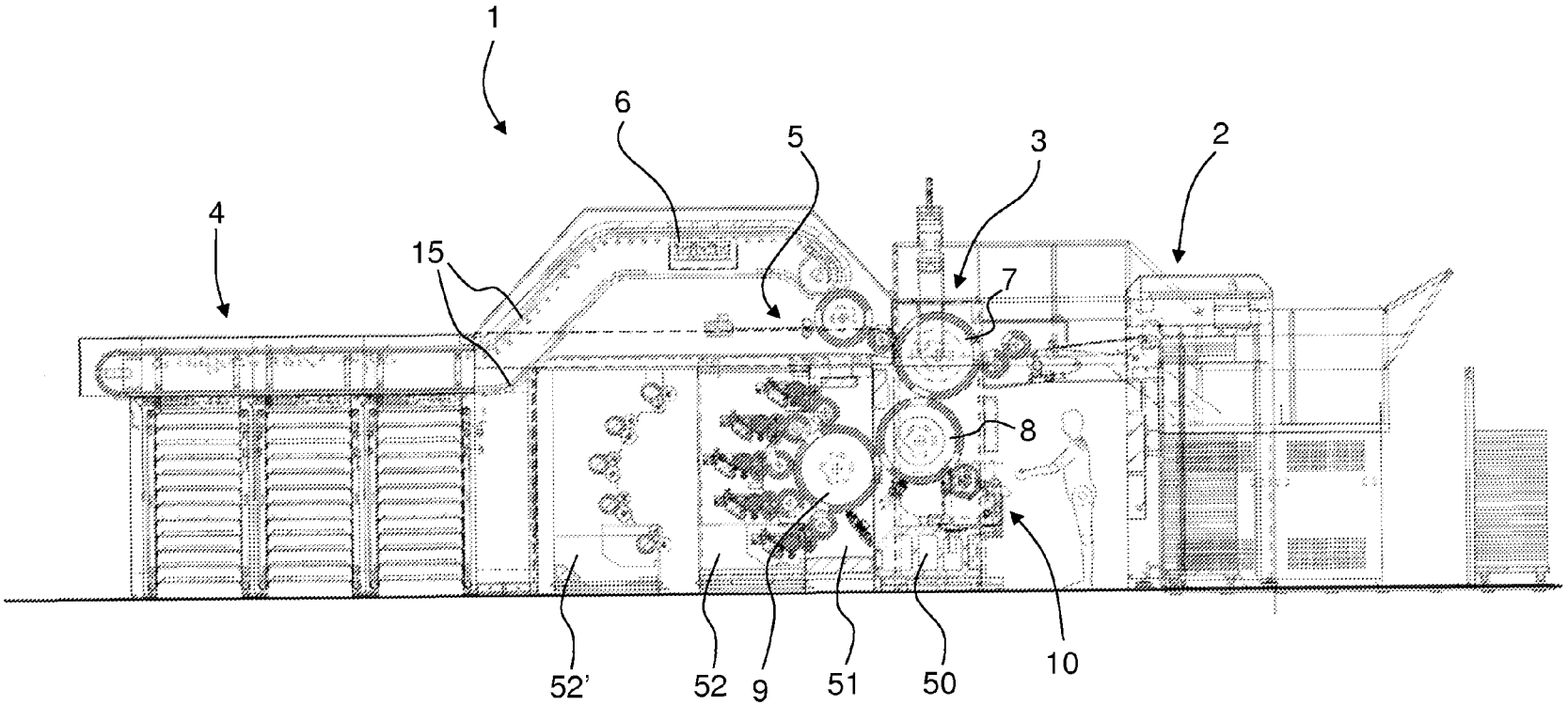
FIG. 1 is a side-view of an intaglio printing press according to a first embodiment of the invention.
Figure 2:
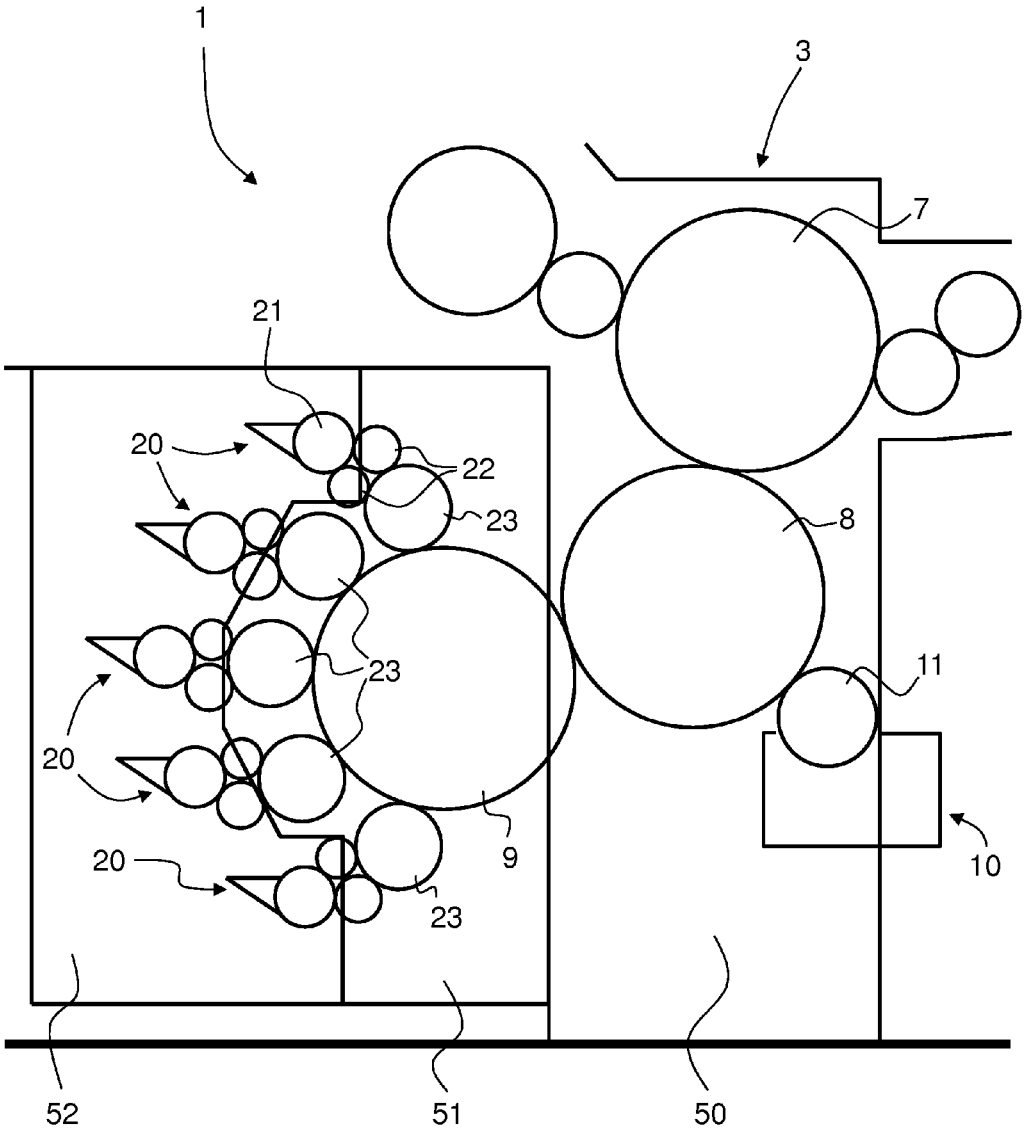
FIG. 2 is an enlarged schematic side view of the printing unit of the intaglio printing press of FIG. 1.
Figure 3:
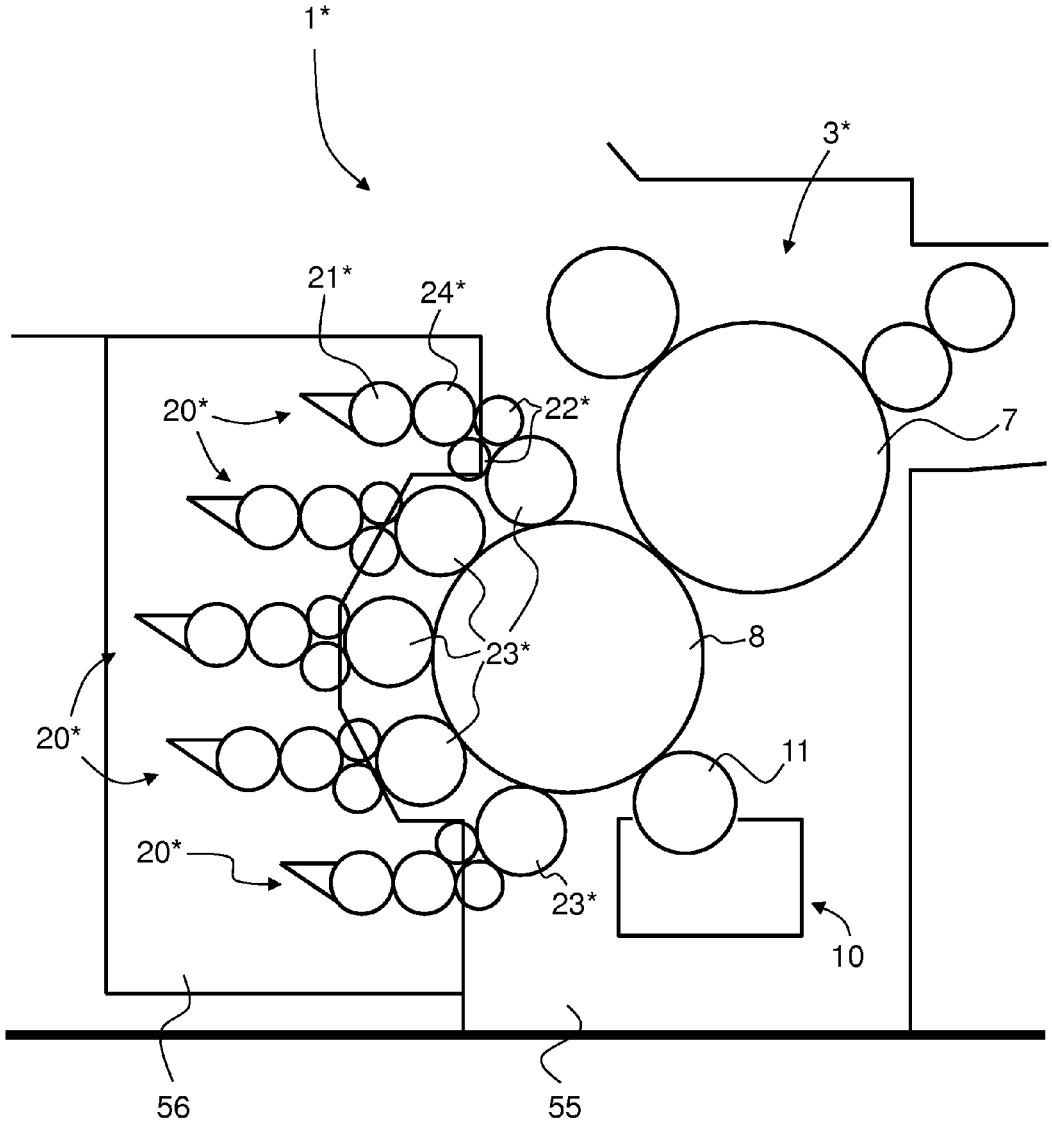
FIG. 3 is a schematic partial side view of an intaglio printing press according to a second embodiment of the invention.

Within the context of the present invention, the expression "chablon cylinder" (which is equivalent to the expression "colour-selector cylinder" also used in the art) is to be understood as designating a cylinder with raised portions whose purpose is to selectively transfer ink patterns to the circumference of the plate cylinder of the intaglio printing press, whether indirectly (as shown in FIGS. 1 and 2) or directly (as shown in FIG. 3). Furthermore, the expression "ink-collecting cylinder" (which is in particular relevant to the embodiment of FIGS. 1 and 2) designates within the context of the present invention a cylinder whose purpose is to collect inks from multiple chablon cylinders (which have been inked by associated inking devices) before transferring the resulting multicolour pattern of inks onto the plate cylinder. In the art of intaglio printing, the expression "Orlof cylinder" is also typically used as an equivalent to the expression "ink-collecting cylinder".

FIGS. 1 and 2 schematically illustrate an intaglio printing press according to a first embodiment of the invention, which printing press is generally designated by reference numeral 1.

More precisely, FIG. 1 shows a sheet-fed intaglio printing press 1 comprising a sheet feeder 2 for feeding sheets to be printed, an intaglio printing unit 3 for printing the sheets, and a sheet delivery unit 4 for collecting the freshly-printed sheets. The intaglio printing unit 3 includes an impression cylinder 7, a plate cylinder 8 (in this example, the plate cylinder 8 is a three-segment plate cylinder carrying three intaglio printing plates), an inking system comprising an ink-collecting cylinder, or Orlof cylinder, 9 (here a three-segment blanket cylinder carrying a corresponding number of blankets) for inking the surface of the intaglio printing plates carried by the plate cylinder 8 and an ink wiping system 10 for wiping the inked surface of the intaglio printing plates carried by the plate cylinder 8 prior to printing of the sheets.

The sheets are fed from the sheet feeder 2 onto a feeder table and then onto the impression cylinder 7. The sheets are then carried by the impression cylinder 7 to the printing nip between the impression cylinder 7 and the plate cylinder 8 where intaglio printing is performed. Once printed, the sheets are transferred away from the impression cylinder 7 for conveyance by a sheet transporting system 15 in order to be delivered to the delivery unit 4. The sheet transporting system 15 conventionally comprises a sheet conveyor system with a pair of endless chains driving a plurality of spaced-apart gripper bars for holding a leading edge of the sheets (the freshly-printed side of the sheets being oriented downwards on their way to the delivery unit 4), sheets being transferred in succession to a corresponding one of the gripper bars.

During their transport to the sheet delivery unit 4, the freshly printed sheets are preferably inspected by an optical inspection system 5. In the illustrated example, the optical inspection system 5 is advantageously an inspection system as disclosed in International Publication No. WO 2011/161656 A1 (which publication is incorporated herein by reference in its entirety), which inspection system 5 comprises a transfer mechanism and an inspection drum located at the transfer section between the impression cylinder 7 and chain wheels of the sheet transporting system 15. The optical inspection system 5 could alternatively be an inspection system placed along the path of the sheet transporting system 15 as described in International Publications Nos. WO 97/36813 A1, WO 97/37329 A1, and WO 03/070465 A1. Such inspection systems are in particular marketed by the Applicant under the product designation NotaSave®.

Before delivery, the printed sheets are preferably transported in front of a drying or curing unit 6 disposed after the inspection system 5 along the transport path of the sheet transporting system 15. Drying or curing could possibly be performed prior to the optical inspection of the sheets.

FIG. 2 is a schematic view of the intaglio printing unit 3 of the intaglio printing press 1 of FIG. 1. As already mentioned, the printing unit 3 basically includes the impression cylinder 7, the plate cylinder 8 with its intaglio printing plates, the inking system with its ink-collecting cylinder 9, and the ink wiping system 10.

The inking system comprises in this example five inking devices 20, all of which cooperate with the ink-collecting cylinder 9 that contacts the plate cylinder 8. It will be understood that the illustrated inking system is adapted for indirect inking of the plate cylinder 8, i.e. inking of the intaglio printing plates via the ink-collecting cylinder 9. The inking devices 20 each include an ink duct 21 cooperating in this example with a pair of ink-application rollers 22. Each pair of ink-application rollers 22 in turn inks a corresponding chablon cylinder 23 which is in contact with the ink-collecting cylinder 9. As is usual in the art, the surface of the chablon cylinders 23 is structured so as to exhibit raised portions corresponding to the areas of the intaglio printing plates intended to receive the inks in the corresponding colours supplied by the respective inking devices 20.

As shown in FIGS. 1 and 2, the impression cylinder 7 and plate cylinder 8 are both supported by a stationary (main) frame 50 of the printing press 1. The inking devices 20 (including the ink duct 21 and ink-application rollers 22) are supported in a mobile inking carriage 52, while the ink-collecting cylinder 9 and chablon cylinders 23 are supported in an intermediate carriage 51 located between the inking carriage 52 and the stationary frame 50. Both the inking carriage 52 and the intermediate carriage 51 are advantageously suspended under supporting rails. In FIG. 1, reference numeral 52' designates the inking carriage 52 in a retracted position.

The twin-carriage configuration of the intaglio printing press 1 illustrated in FIGS. 1 and 2 corresponds in essence to the configuration disclosed in International Publications Nos. WO 03/047862 A1, WO 2011/077348 A1, WO 2011/077350 A1 and WO 2011/077351 A1, all assigned to the present Applicant and which are incorporated herein by reference in their entirety.

The ink wiping system 10, on the other hand, typically comprises a wiping tank, a wiping roller assembly 11 supported on and partly located in the wiping tank and contacting the plate cylinder 8, cleaning means for removing wiped ink residues from the surface of the wiping roller assembly 11 using a wiping solution that is sprayed or otherwise applied onto the surface of the wiping roller assembly 11, and a drying blade contacting the surface of the wiping roller assembly 11 for removing wiping solution residues from the surface of the wiping roller assembly 11. A particularly suitable solution for the ink wiping system 10 is disclosed in International Publication No. WO 2007/116353 A1 which is incorporated herein by reference in its entirety.

FIG. 3 is a schematic partial side view of an intaglio printing press according to a second embodiment of the invention, which intaglio printing press is designated by reference numeral 1*, for the sake of distinction.

In contrast to the first embodiment shown in FIGS. 1 and 2, the intaglio printing press 1* of FIG. 3 comprises a printing unit 3* with a direct inking system (i.e. without any ink-collecting cylinder), the chablon cylinders, designated by reference numerals 23*, cooperating directly with the plate cylinder 8.

The inking devices, designated by reference numerals 20*, each include, in this example, an ink duct 21*, an ink-transfer roller 24*, and a pair of ink-application rollers 22* adapted to cooperate with the associated chablon cylinder 23*. The inking devices 20* are supported on an inking carriage 56 that is adapted to move between a working position (shown in FIG. 3) and a retracted position (not shown) in a way similar to the inking carriage 52 of FIGS. 1 and 2. The impression cylinder 7, plate cylinder 8, chablon cylinders 23* and ink wiping system 10 are all supported in a stationary frame 55 of the intaglio printing press 1*.

Both the intaglio printing press 1 of FIGS. 1 and 2 and the intaglio printing press 1* of FIG. 3 may be provided with an adjustable drive unit in accordance with the invention.

According to the invention which will be described in reference to a preferred embodiment thereof which is illustrated by FIGS. 4 to 9, such an adjustable drive unit is interposed between each chablon cylinder 23/23* (which chablon cylinder acts as a rotating output body of the adjustable drive unit) and a driving gear, designated by reference numeral 100 in FIGS. 4 to 9 (which driving gear 100 acts as a rotating input body of the adjustable drive unit).

In accordance with the invention, the adjustable drive unit is designed to allow selected adjustment of a rotational speed of the chablon cylinder 23/23* with respect to a rotational speed of the driving gear 100. More precisely, in accordance with the invention, in an adjusting state of the adjustable drive unit, driving into rotation of the chablon cylinder 23/23* is adjusted by means of an adjustment motor of the adjustable drive unit. In a non-adjusting state of the adjustable drive unit, the adjustment motor is inoperative and the driving into rotation of the chablon cylinder 23/23* is performed exclusively mechanically via the adjustable drive unit, the chablon cylinder 23/23* rotating at a same rotational speed as the driving gear 100.

More specifically, referring to the preferred embodiment of FIGS. 4 to 9, a purpose of the adjustable drive units is to form part of an adjustment system acting on the associated chablon cylinders 23/23* for compensating elongation of the intaglio printing plates carried by the plate cylinder 8 of the intaglio printing press. In essence, the function and operation of the adjustment system corresponds to those described in International Publication No. WO 2004/069538 A2 (which is incorporated herein by reference), namely to increase an inking length of the chablon cylinders 23/23* as transferred onto the plate cylinder 8 in an amount such that it follows, and therefore compensates, the elongation of each intaglio printing plate. The solution to achieve this function and this operation is however different as this will be explained hereinafter.

Figure 4:
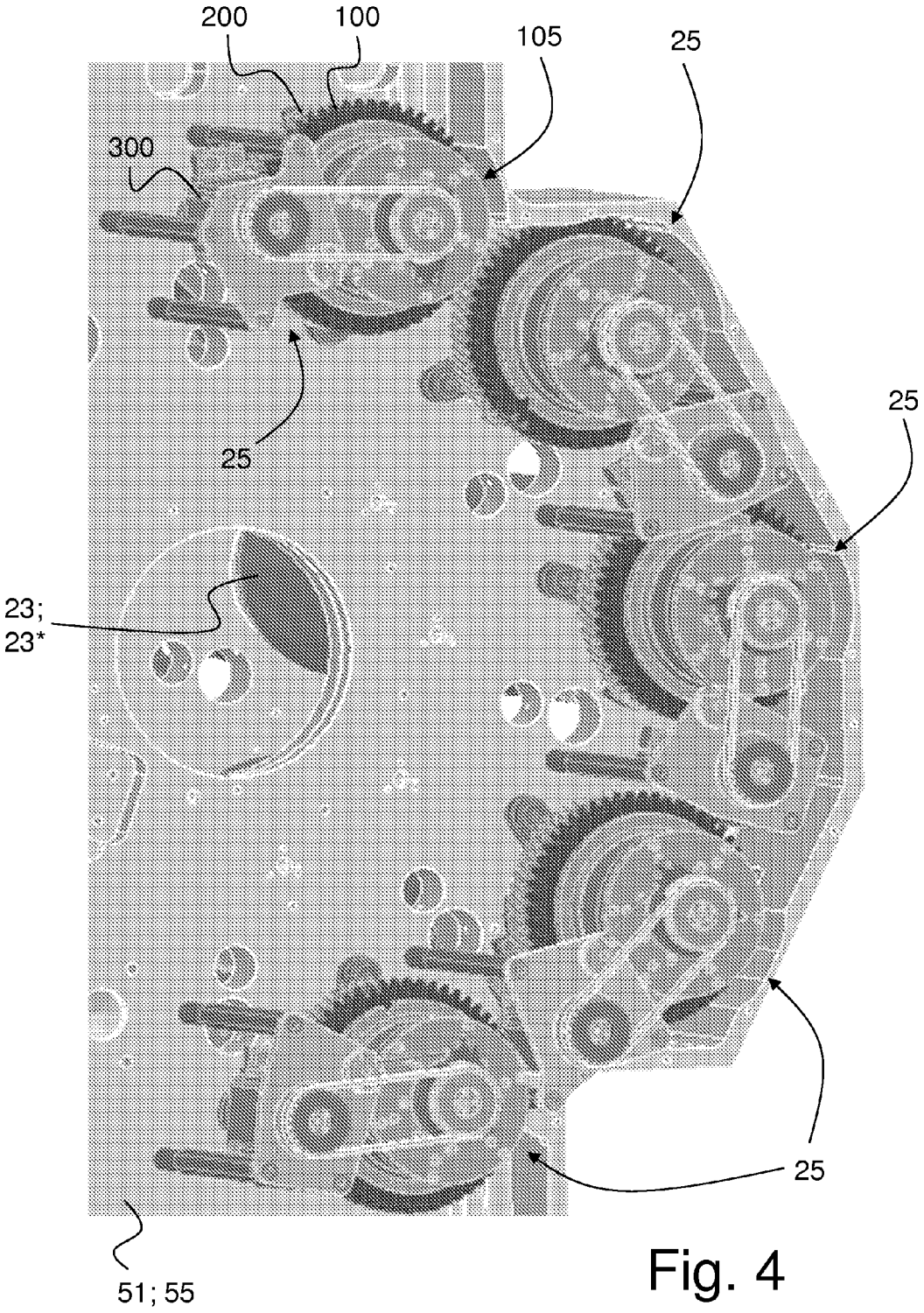
FIG. 4 is a schematic partial perspective view of a plurality of adjustable drive units for driving and adjusting rotation of chablon cylinders of the intaglio printing press of FIGS. 1 and 2 or of FIG. 3 in accordance with a preferred embodiment of the invention.
Figure 5:
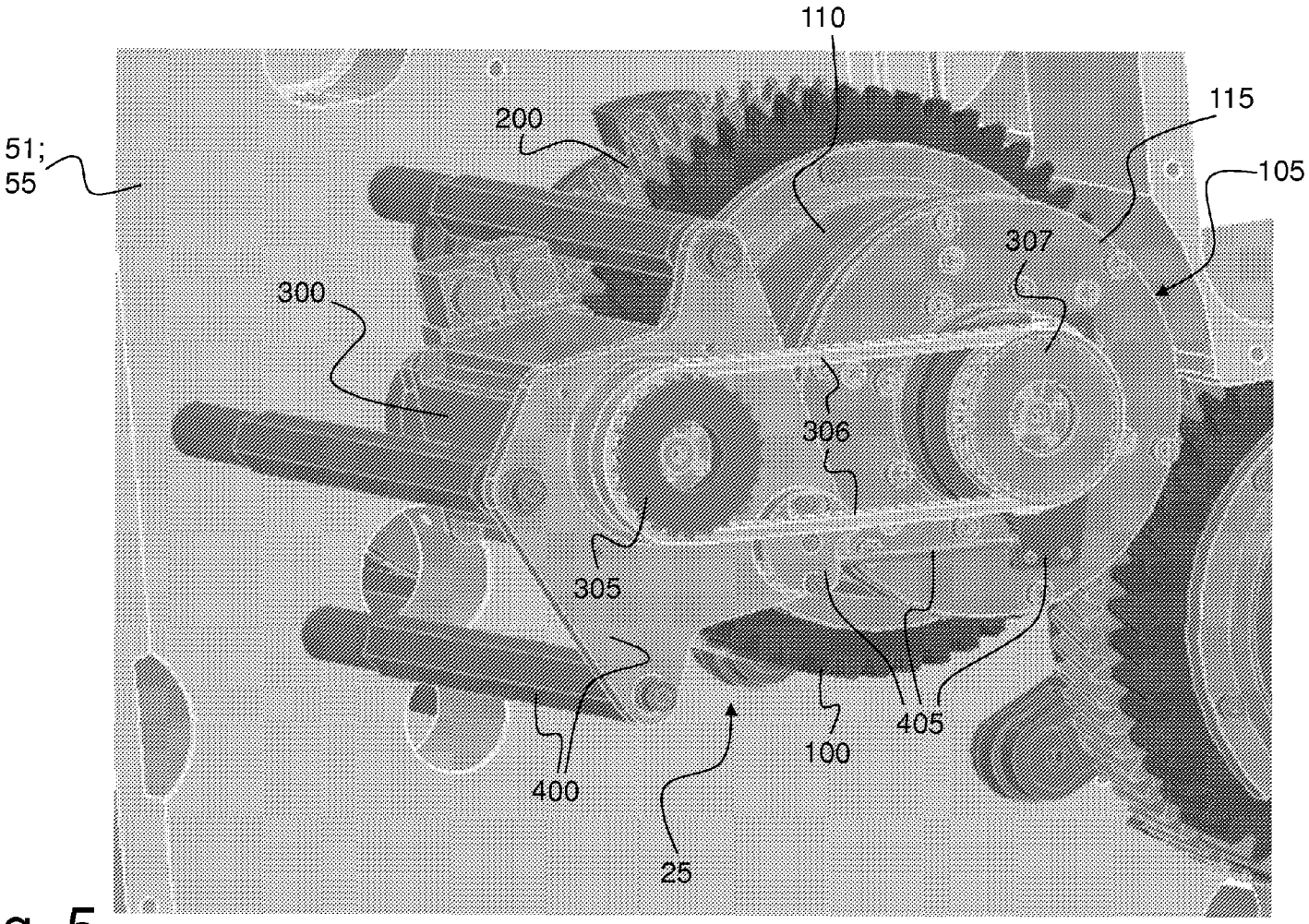
FIG. 5 is an enlarged schematic perspective view of one of the adjustable drive units of FIG. 4.

In order to achieve this aim, the adjustable drive unit of each chablon cylinder 23/23* is switched to an adjusting mode wherein driving into rotation of the chablon cylinder 23/23* is adjusted over each revolution of the chablon cylinder 23/23* by means of an adjustment motor, designated by reference numeral 300 in FIGS. 4 and 5, to change the resulting inking length as transferred onto the plate cylinder 8. More precisely, in order to compensate for an elongation of an intaglio printing plate, the rotational speed of each chablon cylinder needs to be decreased by a corresponding amount during the period where ink transfer occurs (i.e. when the chablon cylinder is in contact with the downstream-located cylinder) thereby leading to a corresponding increase in inking length). In order to ensure appropriate circumferential register between the chablon cylinders 23/23* and the plate cylinder 8, each chablon cylinder 23/23* is accelerated after each ink transfer operation (i.e. when the chablon cylinder is positioned in front of a cylinder pit of the ink-collecting cylinder 9 in FIGS. 1, 2—or of the plate cylinder 8—in FIG. 3) so as to be re-positioned for the start of the subsequent ink transfer operation. In other words, the rotational speed of each chablon cylinder 23/23* is adjusted over each revolution of the chablon cylinder 23/23* in order to compensate elongation of the intaglio printing plate, while ensuring that an average circumferential speed of the chablon cylinder 23/23* corresponds to that of the plate cylinder 8, i.e., in the adjusting state, the rotational speed of the chablon cylinder 23/23* is decreased during ink transfer and increased again after each ink transfer.

FIG. 4 is a schematic partial perspective view of a plurality of (namely five) adjustable drive units, designated by reference numeral 25, for driving and adjusting rotation of the chablon cylinders 23/23* of the intaglio printing press 1 of FIG. 1, 2 or 1* of FIG. 3. Each adjustable drive unit 25 is mounted on a driving side of the intaglio printing press and basically comprises a driving gear 100, forming the rotating input body (or input drive gear) of the adjustable drive unit 25, an adjustable mechanical transmission unit, identified by reference numeral 105, interposed between the driving gear 100 and the chablon cylinder 23/23*, and an adjustment motor 300. The adjustable mechanical transmission unit 105 is mounted on the axis of the chablon cylinder 23/23*, i.e. is coaxial with the associated chablon cylinder 23/23*. The driving gear 100 is driven into rotation by a corresponding gear (not shown) which, in the example of FIGS. 1, 2, drives the ink-collecting cylinder 9 or, in the example of FIG. 3, drives the plate cylinder 8.

In accordance with this first variant, the adjustable mechanical transmission unit is advantageously designed as a particularly compact unit consisting of a harmonic drive unit 105 having a drive input coupled to and rotating together with the driving gear 100, a drive output coupled to and rotating together with the chablon cylinder 23/23*, and a control input coupled to and driven into rotation (when in an adjusting state) by the adjustment motor 300.

In a non-adjusting state of the adjustable drive unit 25, the adjustment motor 300 is inoperative and driving into rotation of the chablon cylinder 23/23* is performed exclusively mechanically via the adjustable drive unit 25 (i.e. via the harmonic drive unit 105), the chablon cylinder 23/23* rotating at a same rotational speed as the driving gear 100 in this example.

A further gear 200, acting as output drive gear, is provided next to the driving gear 100. This output drive gear 200 is coupled to and rotates together with the chablon cylinder 23/23* to drive the inking device 20/20* inking the chablon cylinder 23/23*.

FIG. 5 is an enlarged schematic perspective view of one of the adjustable drive units 25 of FIG. 4 which more clearly illustrates that the adjustment motor 300 is supported by means of a support member 400 onto the same machine frame as the chablon cylinders 23/23*, namely the intermediate carriage 51 in FIGS. 1, 2 or the stationary machine frame 55 in FIG. 3.

In the instant example, the adjustment motor 300 is coupled to the control input of the harmonic drive unit 105 by way of a toothed belt arrangement comprising an output gear 305 mounted on the output shaft of the adjustment motor 300 which drives a toothed belt 306 that is coupled to a control input gear 307 of the harmonic drive unit 105. The adjustment motor 300 could alternatively be mounted directly onto the axis of the chablon cylinder 23/23* or coupled to the control input of the harmonic drive unit 105 by way of other transmission arrangements, such as by way of a worm gear.

Figure 9:
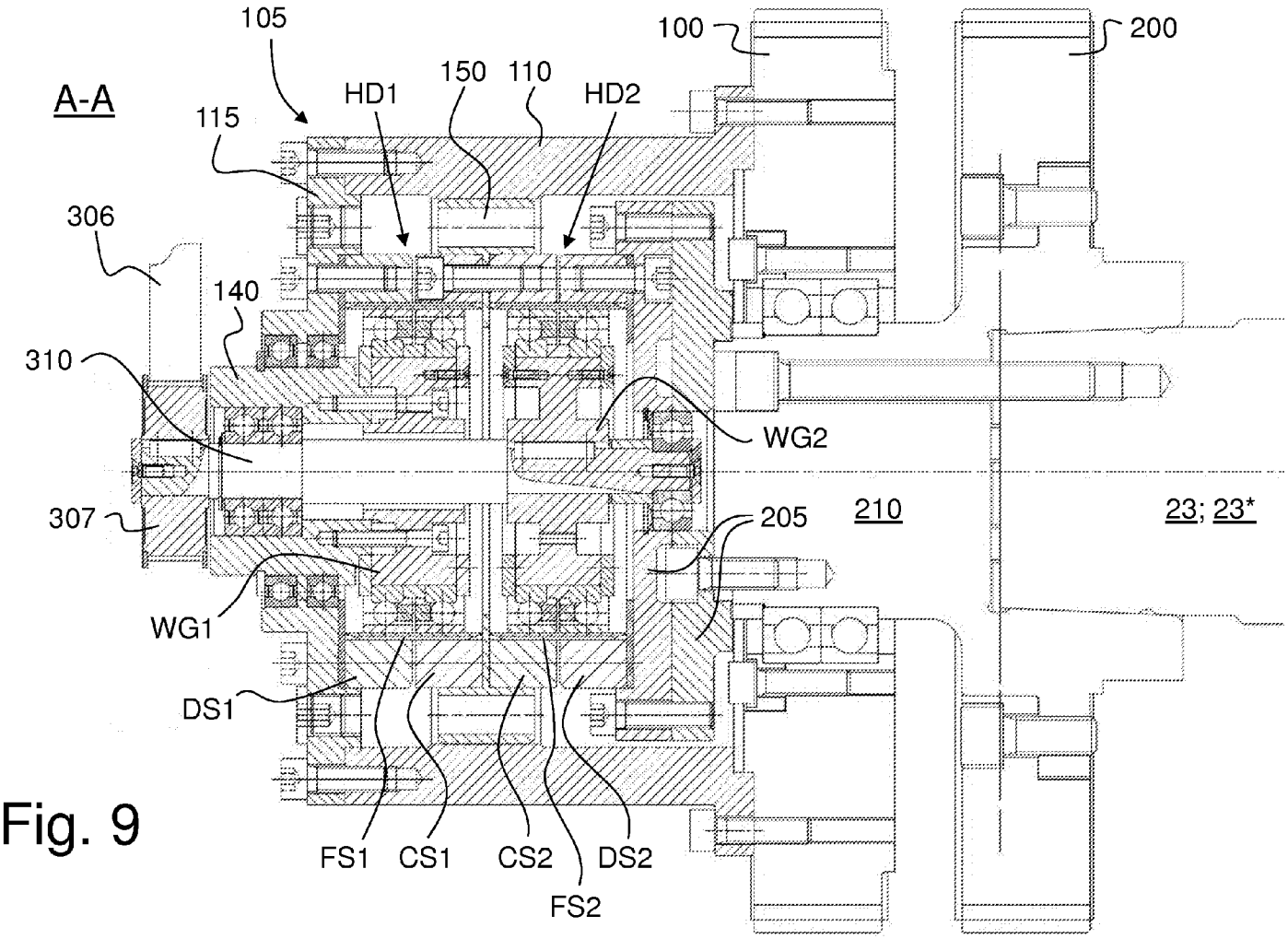
FIG. 9 is a schematic sectional view of the harmonic drive unit as taken along plane A-A indicated in FIG. 7.

As further illustrated in FIG. 5, a support extension 405 is further provided, which support extension 405 is secured at one end to the support member 400 and at the other end to a functional component of the harmonic drive unit 105 (namely component 140 in FIG. 9). FIG. 5 also shows an outer casing 110 and lateral member 115 of the harmonic drive unit 105, both elements 110, 115 being secured to one another and to the driving gear 100.

Figure 6:
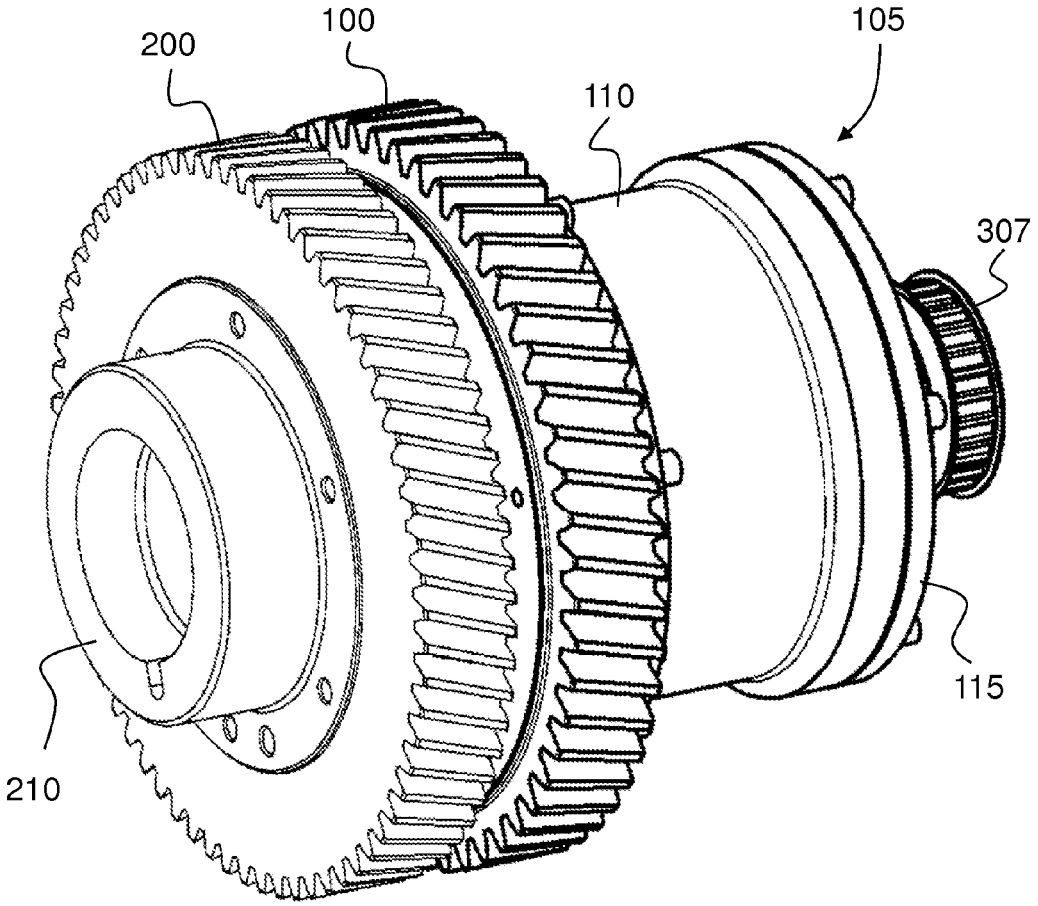
FIG. 6 is a schematic perspective view of an adjustable mechanical transmission unit designed as a harmonic drive unit as used in the preferred embodiment of FIGS. 4 and 5.

FIG. 6 is a schematic perspective view of the harmonic drive unit 105 as used in the preferred embodiment of FIGS. 4 and 5. FIG. 6 shows that a coupling member 210 is provided on the output side of the harmonic drive unit 105 for coupling to a shaft of the associated chablon cylinder 23/23* (not shown in FIG. 6), the coupling member 210 being secured to and rotating together with the output drive gear 200.

Figure 7:
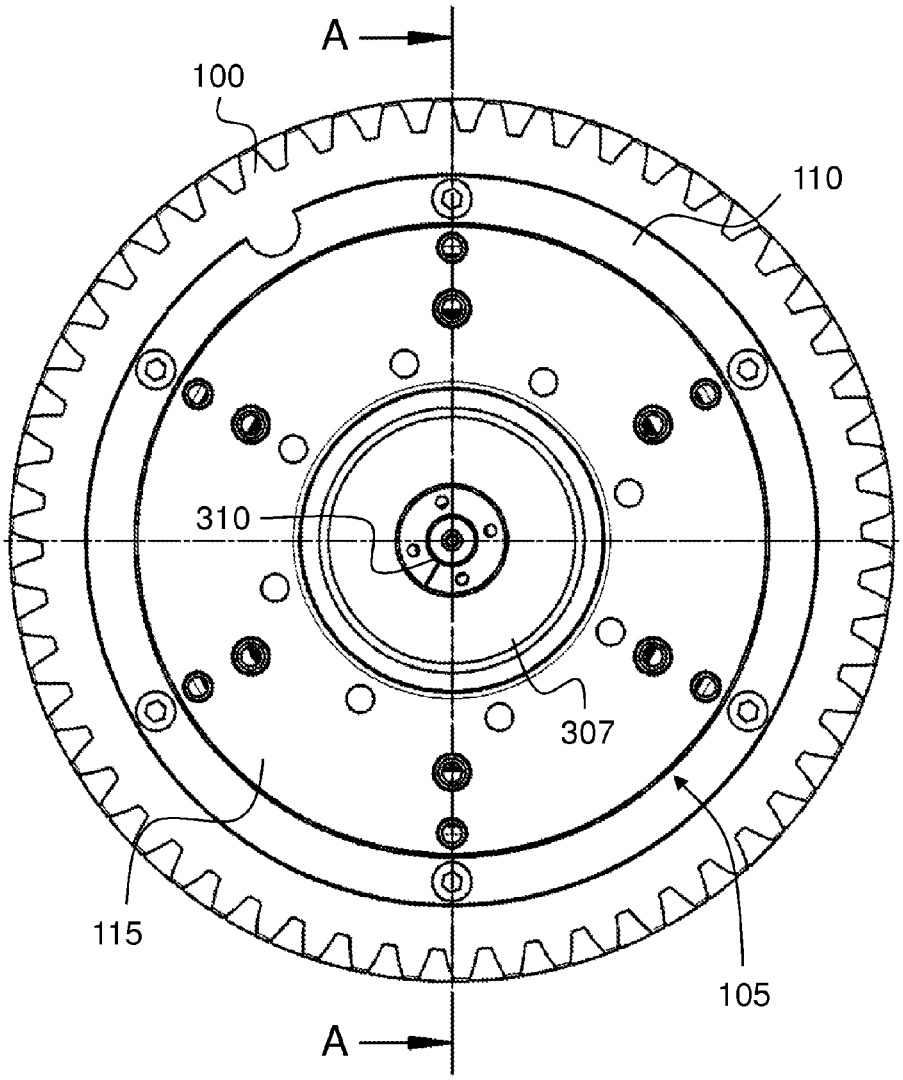
FIG. 7 is a schematic front view of the harmonic drive unit of FIG. 6 as seen from a control input of the harmonic drive unit, opposite to the side intended to be coupled to an associated chablon cylinder.

FIG. 7 is a schematic front view of the harmonic drive unit 105 as seen from the control input side of the harmonic drive unit 105 and which shows that the control input gear 307 is coupled to an extremity of a control shaft 310 penetrating into a central portion of the harmonic drive unit 105.

Figure 8:
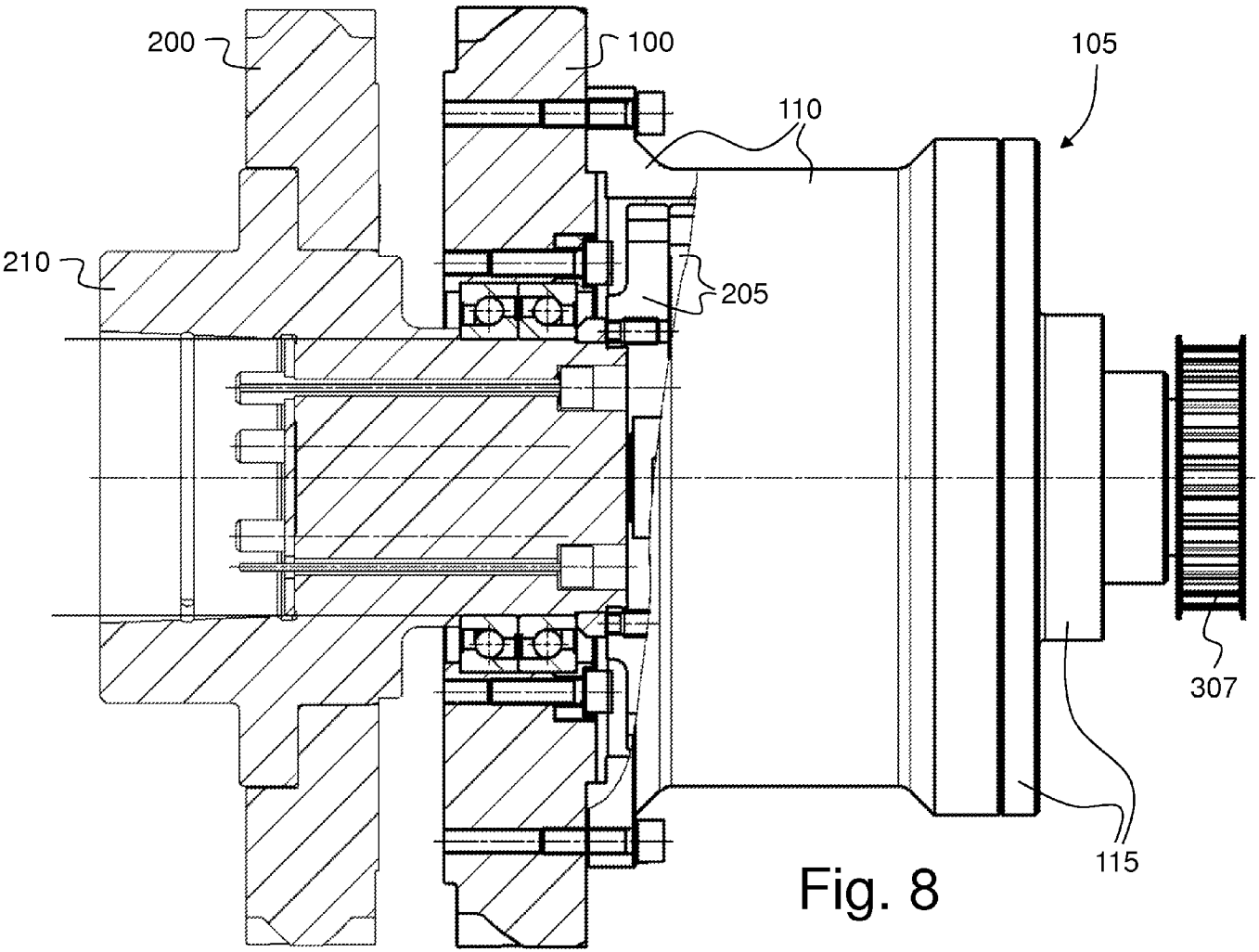
FIG. 8 is a schematic side view of the harmonic drive unit of FIG. 6 as seen along a plane intersecting an axis of rotation of the harmonic drive unit.

FIG. 8 is a schematic side view of the harmonic drive unit 105 as seen along a plane intersecting an axis of rotation of the harmonic drive unit 105. One can again see the driving gear 100 which is secured to the outer casing 110 and the lateral member 115 at the driving input of the harmonic drive unit 105, the control input gear 307 at the control input of the harmonic drive unit 105, and the output drive gear 200 and coupling member 210, the coupling member 210 being secured to an output member 205 at the drive output of the harmonic drive unit 105 (as also shown in FIG. 9).

A preferred configuration of the harmonic drive unit 105 is illustrated in FIG. 9 which is a schematic sectional view of the harmonic drive unit 105 as taken along plane A-A indicated in FIG. 7. As shown in FIG. 9, the harmonic drive unit 105 comprises first and second harmonic drives HD1, HD2 which are coupled to one another in a mirrored configuration. Advantageously, these harmonic drives HD1, HD2 are of a type which is available as such on the market, for instance as so-called "HDUR" gearings from company Harmonic Drive AG (www.harmonicdrive.de).

It will be appreciated that the first and second harmonic drives HD1, HD2 are conveniently located within a housing formed by the outer casing 110 and lateral member 115, thereby suitably protecting the harmonic drives HD1, HD2 from exposure to the environment.

More precisely, in the illustrated example, the first harmonic drive HD1 acts as reducer stage with a defined reduction factor R1, while the second harmonic drive HD2 acts, in the non-adjusting state of the adjustable drive unit 25, as an overdrive stage with a defined overdrive factor that is the inverse 1/R1 of the defined reduction factor R1 of the reducer stage formed by the first harmonic drive HD1. In the adjusting state of the adjustable drive unit 25, the second harmonic drive HD2 acts as a differential stage having a differential output whose rotational speed is a differential function of a rotational speed at a differential input of the differential stage and a rotational speed at a differential control input of the differential stage.

More precisely, each one of the first and second harmonic drives HD1, HD2 comprises a wave generator WG1, WG2, a flexspline FS1, FS2, a circular spline CS1, CS2, and a dynamic spline DS1, DS2. The dynamic spline DS1, DS2 is identified by a chamfered corner and is basically a rigid ring with internal teeth cooperating with external teeth of the associated flexspline FS1, FS2, which is a non-rigid, i.e. flexible, ring which is fitted over and is elastically deflected by the wave generator WG1, WG2 which exhibits an elliptical shape. The number of teeth of the dynamic spline DS1, DS2 is the same as that of the flexspline FS1, FS2, meaning that it rotates together with the flexspline FS1, FS2. In contrast, the circular spline CS1, CS2 is a rigid ring with internal teeth of a larger number compared to the flexspline FS1, FS2, the internal teeth of the circular spline CS1, CS2 engaging the teeth of the flexspline FS1, FS2 across the major axis of the wave generator WG1, WG2.

When assembled, rotation of the wave generator imparts a rotating elliptical shape to the flexspline. This causes progressive engagement of the external teeth of the flexspline with the internal teeth of the circular spline. The circular spline having a larger number of teeth than the flexspline, causes the latter to precess at a rate which is a function of the ratio of tooth difference and the actual configuration of the harmonic drive.

In the illustrated example, the dynamic spline DS1 of the first harmonic drive HD1 acts as drive input of the harmonic drive unit 105 and is secured to the input drive gear 100 via the outer casing 110 and lateral member 115, and thereby rotates together with the driving gear 100. The wave generator WG1 of the first harmonic drive HD1 is fixed in rotation by securing it to a stationary part 140 (which stationary part is fixed to the machine frame by means of the support extension 405 and support member 400 shown in FIG. 5). As a result, the first harmonic drive HD1 operates as a reducer stage with a defined reduction factor R1 which is equal to the ratio R/(R+1) (R being the corresponding ratio of the harmonic drive). In other words, the circular spline CS1 of the first harmonic drive HD1 rotates at a slightly different rotational speed compared to the dynamic spline DS1.

As further shown in FIG. 9, the circular spline CS1 of the first harmonic drive HD1 is coupled to and rotates together with the circular spline CS2 of the second harmonic drive HD2. This is achieved by securing the circular splines CS1 and CS2 together and, in the illustrated example, guiding the circular splines CS1, CS2 for rotation inside the outer casing 110 by way of an intermediate ring 150 (or a suitable ball bearing).

The wave generator WG2 of the second harmonic drive HD2, which acts as the control input of the harmonic drive unit 105, is coupled to and driven into rotation by the adjustment motor 300 (via the toothed belt arrangement of which components 306 and 307 are illustrated in FIG. 9) to act as the control input of the harmonic drive unit 105, this being achieved by securing the already described control shaft 310 that is coupled to the control input gear 307 to the wave generator WG2.

In this case, the dynamic spline DS2 of the second harmonic drive HD2 acts as the drive output of the harmonic drive unit 105 and is secured to the associated chablon cylinder 23/23* via the output member 205 and coupling member 210.

As a result, the second harmonic drive HD2 operates, in the non-adjusting state of the adjustable driving unit 25 (i.e. when the wave generator WG2 is not driven into rotation by the adjustment motor 300) as an overdrive stage with a defined overdrive factor which is equal to the inverse of the reduction factor R1 of the first harmonic drive HD1, i.e. is equal to ratio (R+1)/R. In other words, the dynamic spline DS2 of the second harmonic drive HD2 rotates at a different rotational speed compared to the circular spline CS2, and in a speed ratio that is precisely the inverse of the speed ratio of the first harmonic drive HD1. In the non-adjusting state of the adjustable driving unit 25, the drive output of the harmonic drive unit 105 thus rotates at the same rotational speed as the drive input, i.e. at the same rotational speed as the driving gear 100.

In contrast, when in the adjusting state of the adjustable driving unit 25 (i.e. when the wave generator WG2 is driven into rotation by the adjustment motor 300), the second harmonic drive HD2 acts as differential stage with the differential output (i.e. DS2) having a rotational speed that is a differential function of a rotational speed at the differential input of the second harmonic drive HD2 (i.e. CS2) and a rotational speed at the differential control input of the second harmonic drive HD2 (i.e. WG2). The rotational speed of the drive output and of the associated chablon cylinder 23/23* can accordingly be selectively increased or decreased depending on the rotation imposed by the adjustment motor 300 on the wave generator WG2 of the second harmonic drive HD2.

Suitable bearings (such as ball bearings) are provided to ensure appropriate support and rotation of the various components of the harmonic drive unit 105 as shown in FIG. 9.

Alternative harmonic drive configurations are possible. For instance, the configuration of the first and second harmonic drives HD1, HD2 could be reversed, i.e. the second harmonic drive HD2 could be configured, in the non-adjusting state, as a reducer stage rather than as an overdrive stage and the first harmonic drive HD1 as an overdrive stage, while still operating the second harmonic drive HD2 as a differential stage in the adjusting state. In such a case, the circular spline CS1 of the first harmonic drive would act as the drive input, while the circular spline CS2 of the second harmonic drive HD2 would act as the drive output, the two dynamic splines DS1, DS2 being coupled to one another.

Various modifications and/or improvements may be made to the above-described embodiments without departing from the scope of the invention as defined by the annexed claims.

In particular, while the illustrations of FIGS. 1 to 3 show intaglio printing presses equipped with conventional inking devices, any other suitable inking device could be used for the purpose of inking the chablon cylinders. In that respect, the inking devices could for instance be inking devices as disclosed in International Publication No. WO 2005/077656 A1 (which is also incorporated herein by reference in its entirety). In the context of WO 2005/077656 A1, a precise circumferential register has to be ensured and maintained between the chablon cylinder and the associated selective inking cylinder that carries engravings corresponding to engravings of the intaglio printing medium. This can be ensured by way of a suitable gearing between the chablon cylinder and the inking device, in which case the above-mentioned output drive gear 200 as shown in FIGS. 4 to 9 acts as driving gear for the upstream-located inking device. In this case, when compensation of the elongation of an intaglio printing plate is carried out, driving of the associated inking device will also be adjusted at the same time, thereby ensuring that the engraved selective inking cylinder precisely follows the rotational movement of the associated chablon cylinder.

LIST OF REFERENCE NUMERALS USED THEREIN

1 (sheet-fed) intaglio printing press (first embodiment)
1* (sheet-fed) intaglio printing press (second embodiment)
2 sheet feeder
3 intaglio printing unit (first embodiment)
3* intaglio printing unit (second embodiment)
4 sheet delivery (with three delivery pile units)
5 optical inspection system (e.g. NotaSave®)
6 drying or curing unit
7 impression cylinder (three-segment cylinder)
8 intaglio cylinder (three-segment plate cylinder carrying three intaglio printing plates)
9 ink collecting cylinder/Orlof cylinder (three-segment blanket cylinder—first embodiment)
10 ink wiping system
11 rotating wiping roller assembly of ink wiping system 10 (contacts circumference of intaglio cylinder 8)
15 sheet transporting system (sheet conveyor system with a pair of endless chains driving a plurality of spaced-apart gripper bars for holding a leading edge of the sheets)
20 (five) inking devices (first embodiment)
21 ink duct (first embodiment)
22 ink-application rollers (first embodiment)
23 (five) chablon cylinders/selective inking cylinders transferring ink onto ink-collecting cylinder 9 (first embodiment)
20* (five) inking devices (second embodiment)
21* ink duct (second embodiment)
22* ink-application rollers (second embodiment)
23* (five) chablon cylinders selective inking cylinders transferring ink onto plate cylinder 8 (second embodiment)
24* ink transfer rollers (second embodiment)

25 adjustable drive unit of chablon cylinder 23, 23*

50 stationary machine frame supporting impression cylinder 7, plate cylinder 8 and ink wiping system 10 (first embodiment)

51 intermediate carriage supporting ink-collecting cylinder 9 and chablon cylinders 23 (first embodiment)

52 inking carriage supporting inking devices 20 (first embodiment)

52' inking carriage 52 in the retracted position (first embodiment)

55 stationary machine frame supporting impression cylinder 7, plate cylinder 8, chablon cylinders 23* and ink wiping system 10 (second embodiment)

56 inking carriage supporting inking devices 20* (second embodiment)

100 driving gear of chablon cylinder 23/23*/input drive gear of adjustable drive unit 25

105 adjustable mechanical transmission unit/harmonic drive unit

110 outer casing of harmonic drive unit 105 (secured to driving gear 100)

115 lateral member of harmonic drive unit 105 (secured to outer casing 110 and dynamic spline DS1 of first harmonic drive HD1)

140 stationary part of harmonic drive unit 105 (fixed to machine frame and to wave generator WG1 of first harmonic drive HD1)

150 intermediate ring member coupled to circular spline CS1 of first harmonic drive HD1 and circular spline CS2 of second harmonic drive HD2 (guided for rotation inside outer casing 110)

200 driving gear of inking device 20, 20*/output drive gear of adjustable drive unit 25

205 output member of harmonic drive unit 105 (secured to dynamic spline DS2 of second harmonic drive HD2)

210 coupling member for coupling to shaft of chablon cylinder 23/23* (secured to output member 205 and output drive gear 200)

300 adjustment motor (e.g. servo motor) of adjustable drive unit 25

305 output gear of adjustment motor 300

306 toothed belt

307 control input gear of harmonic drive unit 105 (driven into rotation by toothed belt 306)

310 control shaft coupled to control input gear 307 and wave generator WG2 of second harmonic drive HD2

400 support member supporting adjustment motor 300 (secured to intermediate carriage 51 or stationary machine frame 55)

405 support extension secured to support member 400 and stationary part 140 of harmonic drive unit 105

HD1 first harmonic drive (e.g. "HDUR" gearing from Harmonic Drive AG—www.harmonicdrive.de) of harmonic drive unit 105 acting as reducer stage CS1 circular spline (or "circular spline S") of first harmonic drive HD1 (larger number of teeth than flexspline FS1)

DS1 dynamic spline (or "circular spline D") of first harmonic drive HD1 (same number of teeth as flexspline FS1)/acts as drive input of harmonic drive unit 105

FS1 flexspline of first harmonic drive HD1

WG1 wave generator of first harmonic drive HD1 (fixed in rotation)

HD2 second harmonic drive (e.g. "HDUR" gearing from Harmonic Drive AG—www.harmonicdrive.de) of harmonic drive unit 105 acting as overdrive stage or differential stage depending on operation of wave generator WG2

CS2 circular spline (or "circular spline S") of second harmonic drive HD2 (larger number of teeth than flexspline FS2)/coupled to and rotates together with circular spline CS1 of first harmonic drive HD1

DS2 dynamic spline (or "circular spline D") of second harmonic drive HD2 (same number of teeth as flexspline FS2)/acts as drive output of harmonic drive unit 105

FS2 flexspline of second harmonic drive HD2

WG2 wave generator of second harmonic drive HD2/acts as control input of harmonic drive unit 105

The invention claimed is:

1. An intaglio printing press comprising a plate cylinder carrying one or more intaglio printing plates, the plate cylinder receiving ink from an inking system having a plurality of chablon cylinders transferring ink directly or indirectly onto the plate cylinder, the intaglio printing press comprising an adjustment system acting on the chablon cylinders in order to compensate for elongation of the one or more intaglio printing plates, wherein the adjustment system comprises, for each chablon cylinder, an adjustable drive unit, which adjustable drive unit is interposed between the chablon cylinder acting as a rotating output body of the adjustable drive unit and a driving gear acting as a rotating input body of the adjustable drive unit, wherein the adjustable drive unit is designed to allow selected adjustment of a rotational speed of the chablon cylinder with respect to a rotational speed of the driving gear, wherein, in an adjusting state of the adjustable drive unit, driving into rotation of the chablon cylinder is adjusted over each revolution of the chablon cylinder by means of an adjustment motor of the adjustable drive unit to change an inking length of the chablon cylinder as transferred onto the plate cylinder, wherein, in a non-adjusting state of the adjustable drive unit, the adjustment motor is inoperative and driving into rotation of the chablon cylinder is performed exclusively mechanically via the adjustable drive unit, the chablon cylinder rotating at a same rotational speed as the driving gear, wherein the adjustable drive unit comprises an adjustable mechanical transmission unit having a drive input coupled to and rotating together with the driving gear, a drive output coupled to and rotating together with the chablon cylinder, and a control input coupled to and driven into rotation by the adjustment motor, and wherein the adjustable mechanical transmission unit is designed as a harmonic drive unit comprising first and second harmonic drives coupled to one another in a mirrored configuration.

2. The intaglio printing press as defined in claim 1, wherein the first harmonic drive acts as a reducer stage with a defined reduction factor, wherein the second harmonic drive acts, in the non-adjusting state of the adjustable drive unit, as an overdrive stage with a defined overdrive factor that is the inverse of the defined reduction factor of the reducer stage, and wherein the second harmonic drive acts, in the adjusting state of the adjustable drive unit, as a differential stage having a differential output whose rotational speed is a differential function of a rotational speed at a differential input of the differential stage and a rotational speed at a differential control input of the differential stage.

3. The intaglio printing press as defined in claim 2, wherein each one of the first and second harmonic drives comprises a wave generator, a flexspline, a circular spline, and a dynamic spline, wherein the dynamic spline of the first harmonic drive is coupled to the driving gear to act as the drive input of the harmonic drive unit, wherein the wave generator of the first harmonic drive is fixed in rotation, wherein the circular spline of the first harmonic drive is coupled to and rotates together with the circular spline of the second harmonic drive, wherein the wave generator of the second harmonic drive is coupled to and driven into rotation by the adjustment motor to act as the control input of the harmonic drive unit, and wherein the dynamic spline of the second harmonic drive is coupled to and rotates together with the chablon cylinder to act as the drive output of the harmonic drive unit.

4. The intaglio printing press as defined in claim 1, wherein the first and second harmonic drives are located within a housing of the adjustable mechanical transmission unit.

5. The intaglio printing press as defined in claim 4, wherein the housing comprises an outer casing and a lateral member which are secured to one another and to the driving gear.

6. The intaglio printing press as defined in claim 1, wherein each adjustable mechanical transmission unit is coaxial with the associated chablon cylinder.

7. The intaglio printing press as defined in claim 6, wherein the adjustment motor is mounted directly onto the axis of the associated chablon cylinder.

8. The intaglio printing press as defined in claim 1, wherein the adjustment motor is coupled to the control input of the adjustable mechanical transmission unit by way of a toothed belt arrangement.

9. The intaglio printing press as defined in claim 1, wherein the adjustment motor is supported on a same machine frame as the chablon cylinders.

10. An adjustment system designed to compensate for elongation of one or more intaglio printing plates of an intaglio printing press comprising a plate cylinder carrying the one or more intaglio printing plates, the plate cylinder receiving ink from an inking system having a plurality of chablon cylinders transferring ink directly or indirectly onto the plate cylinder, which adjustment system comprises, for each chablon cylinder of the intaglio printing press, an adjustable drive unit, which adjustable drive unit is interposed between the chablon cylinder acting as a rotating output body of the adjustable drive unit and a driving gear acting as a rotating input body of the adjustable drive unit, wherein the adjustable drive unit is designed to allow selected adjustment of a rotational speed of the chablon cylinder with respect to a rotational speed of the driving gear, wherein, in an adjusting state of the adjustable drive unit, driving into rotation of the chablon cylinder is adjusted over each revolution of the chablon cylinder by means of an adjustment motor of the adjustable drive unit to change an inking length of the chablon cylinder as transferred onto the plate cylinder of the intaglio printing press, wherein, in a non-adjusting state of the adjustable drive unit, the adjustment motor is inoperative and driving into rotation of the chablon cylinder is performed exclusively mechanically via the adjustable drive unit, the chablon cylinder rotating at a same rotational speed as the driving gear, wherein the adjustable drive unit comprises an adjustable mechanical transmission unit having a drive input coupled to and rotating together with the driving gear, a drive output coupled to and rotating together with the chablon cylinder, and a control input coupled to and driven into rotation by the adjustment motor, and wherein the adjustable mechanical transmission unit is designed as a harmonic drive unit comprising first and second harmonic drives coupled to one another in a mirrored configuration.

11. The adjustment system as defined in claim 10, wherein the first harmonic drive acts as a reducer stage with a defined reduction factor, wherein the second harmonic drive acts, in the non-adjusting state of the adjustable drive unit, as an overdrive stage with a defined overdrive factor that is the inverse of the defined reduction factor of the reducer stage, and wherein the second harmonic drive acts, in the adjusting state of the adjustable drive unit, as a differential stage having a differential output whose rotational speed is a differential function of a rotational speed at a differential input of the differential stage and a rotational speed at a differential control input of the differential stage.

12. The adjustment system as defined in claim 11, wherein each one of the first and second harmonic drives comprises a wave generator, a flexspline, a circular spline, and a dynamic spline, wherein the dynamic spline of the first harmonic drive is coupled to the driving gear to act as the drive input of the harmonic drive unit, wherein the wave generator of the first harmonic drive is fixed in rotation, wherein the circular spline of the first harmonic drive is coupled to and rotates together with the circular spline of the second harmonic drive, wherein the wave generator of the second harmonic drive is coupled to and driven into rotation by the adjustment motor to act as the control input of the harmonic drive unit, and wherein the dynamic spline of the second harmonic drive is coupled to and rotates together with the chablon cylinder to act as the drive output of the harmonic drive unit.

13. The adjustment system as defined in claim 10, wherein the first and second harmonic drives are located within a housing of the adjustable mechanical transmission unit.

14. The adjustment system as defined in claim 13, wherein the housing comprises an outer casing and a lateral member which are secured to one another and to the driving gear.

15. The adjustment system as defined in claim 10, wherein each adjustable mechanical transmission unit is coaxial with the associated chablon cylinder.

16. The adjustment system as defined in claim 15, wherein the adjustment motor is mounted directly onto the axis of the associated chablon cylinder.

17. The adjustment system as defined in claim 10, wherein the adjustment motor is coupled to the control input of the adjustable mechanical transmission unit by way of a toothed belt arrangement.

* * * * *